United States Patent [19]

Meier

[11] Patent Number: 4,575,988

[45] Date of Patent: Mar. 18, 1986

[54] METHOD AND APPARATUS FOR STORING CONTINUOUSLY ARRIVING FLAT PRODUCTS, ESPECIALLY PRINTED PRODUCTS, AND PRODUCT PACKAGE FORMED FROM SUCH PRODUCTS

[75] Inventor: Jacques Meier, Bäretswil, Switzerland

[73] Assignee: FERAG AG, Hinwil, Switzerland

[21] Appl. No.: 445,565

[22] Filed: Nov. 29, 1982

[30] Foreign Application Priority Data

Dec. 9, 1981 [CH] Switzerland ..... 7854/81

[51] Int. Cl.[4] ..... B65B 63/04

[52] U.S. Cl. ..... 53/399; 53/430; 53/118; 53/587; 206/390; 206/412; 242/55; 414/29

[58] Field of Search ..... 53/430, 118, 593, 587, 53/556, 441, 399, 211, 212, 214; 414/29, 32, 57, 68; 242/59, 67.2, 67.3 R, 67.4, 55, DIG. 2; 270/52, 54, 56, 52.5; 226/76; 271/151, 202, 216, 303

[56] References Cited

U.S. PATENT DOCUMENTS

| | | | |
|---|---|---|---|
| 1,004,028 | 9/1911 | Howe | 206/412 |
| 1,902,312 | 3/1933 | Rous | 206/412 |
| 2,679,968 | 6/1954 | Richter | 206/412 X |
| 2,922,206 | 1/1960 | Schmertz | 206/412 X |
| 3,488,917 | 1/1970 | Oswald et al. | 414/29 X |
| 4,010,945 | 3/1977 | Kistner | 271/255 X |
| 4,326,632 | 4/1982 | Koob | 206/412 X |
| 4,438,618 | 3/1984 | Honegger | 414/29 X |

FOREIGN PATENT DOCUMENTS

| | | | |
|---|---|---|---|
| 2092557 | 8/1982 | United Kingdom | 242/59 |

*Primary Examiner*—Horace M. Culver
*Attorney, Agent, or Firm*—Werner W. Kleeman

[57] ABSTRACT

Firstly, a leading first portion of the continuously arriving stream of printed products is stored in the form of an intermediate package present on a winding core journaled for rotation. Subsequently the printed products are again unwound from the intermediate package and joined with a successive second portion of the stream of printed products. In so doing the products in the second portion come to lie in superimposed fashion upon the printed products withdrawn from the intermediate package. Both of the superimposed imbricated product streams are conjointly wound-up upon a rotationally driven winding core to form a primary product package. During exchange of the completed primary product package against a further winding core, the printed products arriving within the period of time needed for this exchange operation are again fed to the intermediate winding core which has now been emptied. These printed products are then wound-up to form an intermediate product package. Therefore, the continuously arriving stream of products does not have to be interrupted during the exchange of a completed primary product package for a new empty winding core.

21 Claims, 2 Drawing Figures

METHOD AND APPARATUS FOR STORING CONTINUOUSLY ARRIVING FLAT PRODUCTS, ESPECIALLY PRINTED PRODUCTS, AND PRODUCT PACKAGE FORMED FROM SUCH PRODUCTS

CROSS REFERENCES TO RELATED APPLICATIONS

This application is related to (i) the commonly assigned, copending U.S. application Ser. No. 06/280,998, filed July 6, 1981, now U.S. Pat. No. 4,438,618, granted Mar. 27, 1984, entitled "Apparatus for Stacking Printed Products, Such As Newspapers, Periodicals and the Like, Arriving in an Imbricated Product Stream"; (ii) the commonly assigned, copending U.S. application Ser. No. 06/338,568, filed Jan. 11, 1982, now U.S. Pat. No. 4,494,359, granted Jan. 22, 1985 entitled "Method and Apparatus for the Long-Term Pressing of Printed Products, Especially Newspapers"; (iii) the commonly assigned, copending U.S. application Ser. No. 06/412,843, filed Aug. 30, 1982, entitled "Winding Body for Winding-up Continuously Arriving Flat Structures, Especially Printed Products in an Imbricated Product Formation"; (iv) the commonly assigned, copending U.S. application Ser. No. 432,557, filed Oct. 4, 1982, entitled "Apparatus for the Storage of Flat Products Arriving in an Imbricated Formation, Especially Printed Products"; and (v) the commonly assigned, copending U.S. application Ser. No. 06/445,564, filed Nov. 29, 1982, entitled "Method of, and Apparatus for, Removing Flat Products, Especially Printed Products, From a Winding Core".

BACKGROUND OF THE INVENTION

The present invention relates to a new and improved method of, and apparatus for, storing continuously arriving flat products, especially printed products, particularly those arriving in an imbricated formation.

At times throughout this disclosure reference to such method and apparatus will simply generally be made in terms of measures for accomplishing such storage of the printed products. Equally, while the description to follow, as a matter of convenience, refers to the processing of printed products, obviously other types of products can be conveniently handled, and therefore, the use of this term is not to be construed in a limiting sense in any way whatsoever, merely is to be viewed as an exemplary and desirable field of application for the inventive measures.

The present invention relates specifically to a new and improved method of, and apparatus for, the storing of continuously arriving flat products in which a continuous stream of products is conveyed from a source to a storage station, and such storage station includes a wind-up location equipped with a winding core.

It is known to wind-up flat products of the most different kinds, which arrive continuously, on a winding core, such as, for instance, disclosed in German Patent Publication No. 2,544,135, German Pat. No. 1,244,656 and German Pat. No. 2,207,556. In case the number of products to be handled in this way exceeds the capacity of the product package upon the winding core then techniques have to be undertaken to achieve that, if the winding core is filled, the further arriving products can be wound-up upon a new empty winding core during the handling operations. For example, it is possible to interrupt the arrival of the products for that period of time during which the completed product package is exchanged against an empty winding core. Additionally, it is also known from German Patent Publication No. 2,544,135 to provide two alternatively charged winding stations, of which a respective one is supplied with the products, while the completed product package is removed from the respective other winding station.

While with the last-mentioned proposal it is unnecessary to interrupt the stream of products, a considerable machinery expense is however required in view of the required doubling of the winding stations.

SUMMARY OF THE INVENTION

Therefore, with the foregoing in mind it is a primary object of the present invention to provide a new and improved method of and apparatus for, storing continuously arriving flat products, especially printed products, arriving particularly in an imbricated product formation, in a manner not afflicted with the aforementioned drawbacks and limitations heretofore discussed.

Another and more specific object of the present invention is directed to the provision of a new and improved method of, and apparatus for, storing continuously arriving flat products, especially printed products, arriving particularly in an imbricated formation, which enables the arriving products to be processed continuously and without interruption at a single winding station or location.

Now in order to implement these and still further objects of the invention, which will become more readily apparent as the description proceeds, the method of the present development is manifested by the features that, in each case a first leading portion of the products is infed with a time-delay to the winding location and at the same time is wound-up with the second subsequent portion of the products.

In its more particular aspects, the stream of products is divided to form a first portion and a second portion of said stream of products, said first portion constituting a leading portion of said stream of products which is delayed before being fed to the wind-up location, and the second subsequent or trailing portion of the stream of products is fed to the wind-up location simultaneously with the first portion.

During the delay which the leading portion of the stream of products to the winding location is subjected to, the completed product package may be exchanged against an empty winding core. Thereafter, this first portion of the stream of products is conjointly wound upon the winding core along with the subsequent second portion of the stream of products which is fed directly to the winding location. If the two product portions of the stream of products are fed to the winding core in a superimposed manner, then twin layers or double plies will form the product package on the winding core. However, it is also possible to wind the two portions of the stream of products in juxtaposition to each other on the winding core.

Preferably, the first portion of the stream of products is first supplied to an intermediate winding core to form an intermediate package, and then unwound therefrom, and in conjunction with the second portion of the stream of products, the first and the second portions of the stream of products are fed to the wind-up location or station for forming the primary or main package.

As alluded to above, the invention is not only concerned with the aforementioned method aspects, but also relates to a novel construction of apparatus for the performance thereof. Generally speaking, the inventive apparatus comprises means for the delayed infeed of a first leading portion of the products to the winding or wind-up location, and means for simultaneously infeeding this first product portion of the stream of products and the second trailing portion of the stream of products to the wind-up location.

To achieve the aforementioned measures the inventive apparatus for storing continuously arriving flat products, especially printed products, arriving particularly in an imbricated product formation, in its more specific aspects, comprises:

a wind-up location including a winding core having an axis of rotation, said winding core winding-up an arriving stream of products so as to form a primary product package;

drive means for driving said winding core for rotation about the axis of rotation;

infeed or conveying means for feeding the stream of products to the wind-up location;

said infeed means including delaying means for the delayed feeding of a leading first portion of the stream of products to the wind-up location, said delaying means feeding the first product portion together with a second, consecutive or subsequent portion of the stream of products to the wind-up location.

Preferably, the infeed or conveying means may comprise a first branch containing the delaying means for the delayed feeding of the first product portion and a second branch for the direct feeding of the second product portion of the stream of products to the wind-up location, and switching means for selectively supplying either one or the other of the two branches. The first branch may include a winding core adapted to be driven in each one of two opposed rotational directions, and an intermediate product package is formed thereon by taking-up the first portion of the stream of products upon this winding core.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
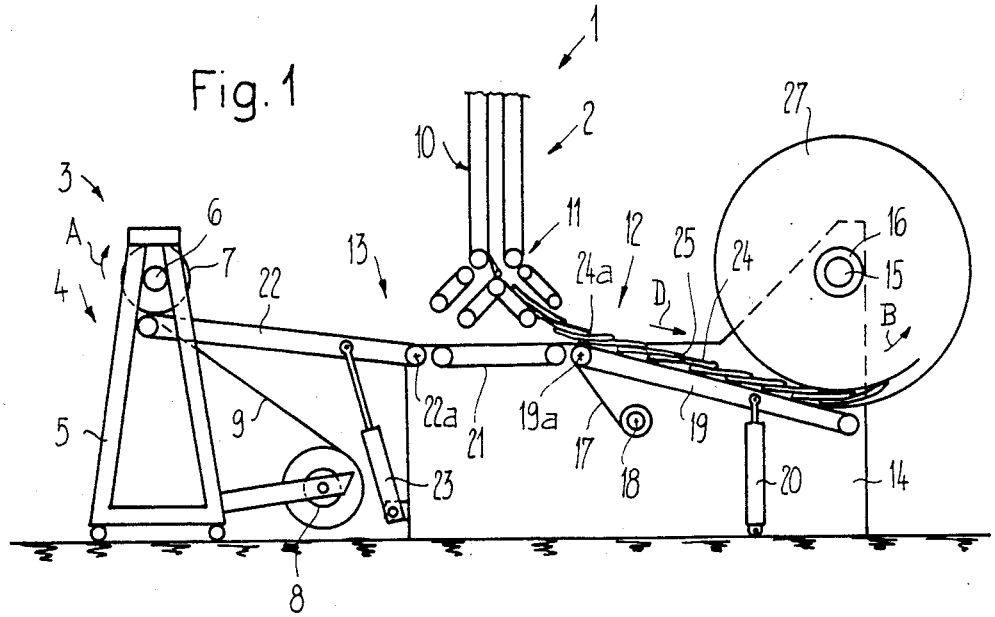
FIG. 1 is a schematic side view of a wind-up station according to the invention and depicted in an intermediate stage of operation.

Describing now the drawings, it is to be understood that only enough of the construction of the winding-up or wind-up station has been shown as needed for those skilled in the art to readily understand the underlying principles and concepts of the present development, while simplifying the showing of the drawings. Turning attention now specifically to FIG. 1, there has been schematically illustrated a wind-up station 1 containing infeed or conveying means generally designated by reference character 2 and following thereat a wind-up location 3. There is disposed at the wind-up location 3 a wind-up and storage unit 4 which is described in detail in the aforementioned commonly assigned, copending U.S. patent application Ser. No. 432,557, filed Oct. 4, 1982, entitled "Apparatus for the Storage of Flat Products Arriving in an Imbricated Formation, Especially Printed Products" to which reference may be had and the disclosure of which is incorporated herein by reference.

The wind-up and storage unit 4 comprises a mobile frame 5 forming a pedestal or support unit. A shaft 6 of a substantially cylindrical winding core 7 is rotatably journaled within the frame 5. The winding core 7 is driven by any conventional drive means in the direction of the arrow A. Furthermore, a band spool member 8 with a wind-up band 9 and defining a storage for such wind-up band is journaled in the frame 5. The wind-up band 9 constitutes a separation band composed of a tension-resistant material, for example, a synthetic or plastics material, one end of the wind-up band 9 being fixedly connected to the winding core 7. Upon rotation of the winding core 7 the wind-up band 9 is withdrawn from the spool member 8. Conventional means (now shown) like, for example, a suitable brake, are provided in order to maintain the wind-up band 9 under tension as it is wound-up upon the winding core 7.

The infeed or conveying means 2 comprises a conventional feeder or infeed device 10 which has only been illustrated schematically and which is formed, for instance, in the present case, by two band or belt conveyors. The infeed device or feeder 10 is followed by switching or directing means 11 which is conventional in nature and therefore only has been schematically shown. The switching means 11 permits the infeed device or feeder 10 to be selectively connected either to a first branch 12 or to a second branch 13 of the infeed or conveying means 2.

A frame 14 is arranged below the switching means 11, and a shaft 15 of a further intermediate winding core 16 is rotatably journaled therein. One end of an additional wind-up band 17 is connected to the winding core 16 and the wind-up band 17 is wound on to a supply roller or roll 18 defining a storage and which is also retained in the frame 14. A conveyor belt rocker or balance 19 defining a support element is mounted in the frame 14 below the winding core 16 for pivotal movement about a pivot shaft or axis 19*a*. A pressing or contact mechanism 20 acts on the conveyor belt rocker 19; the pressing mechanism 20 comprises a loaded spring or spring storage or equivalent structure and is secured to the frame 14 such as to urge the rocker 19 towards the winding core 16 or, as the case may be, against the product package forming at the winding core 16. At the end opposite the winding core 16 a conveyor belt 21 follows the conveyor belt or band rocker 19. Intermediate the conveyor belt 21 and the winding core 7 of the wind-up and storage station 4 there is arranged another conveyor belt rocker 22, likewise defining a support element, for pivotal movement about a pivot shaft or axis 22*a* in the frame 14. The conveyor belt rocker 22 also extends below the winding core 7 and is urged against the winding core 7 or, as the case may be, against the product package forming thereon by means of a pressing or contact mechanism 23 which also includes a loaded spring or spring storage.

The wind-up station 1 as described hereinbefore operates as follows:

The printed products 24 to be wound-up upon the winding core 7 arrive in an imbricated product formation, i.e. in a superimposed configuration in the manner of tiles on a roof. The infeed device or feeder 10 conducts the printed products 24 to the switching or directing means 11. The switching means 11 directs the leading first portion 25 of the printed products 24 to the first branch 12 of the infeed or conveying means 2 as shown in FIG. 1. The winding core 16 is driven in the direction of the arrow B by conventional drive means not shown in detail. The printed products 24 of the first portion 25 are fed in an undershot way i.e. from below to the wind-up core 16 in the direction of the arrow D by means of the conveyor belt rocker 19 and are wound thereon. Simultaneously, the separation wind-up band 17 maintained under tension is wound-up therewith and forms a separation layer between the individual wound layers or plies. As shown in FIG. 1, the printed products 24 are wound upon the winding core 16 with their folding edge 24*a* leading.

Figure 2:
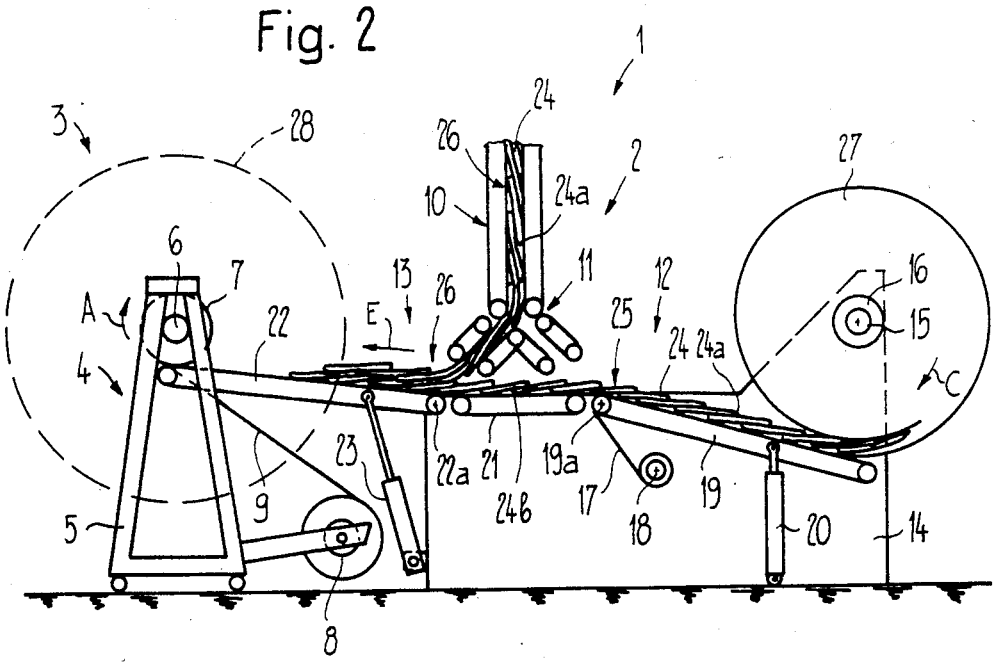
FIG. 2 is a side view of the wind-up station shown in FIG. 1 at a later operational stage.

After the last member of the printed products 24 of the leading first portion 25 has passed the switching means 11, such switching means 11 are switched or reversed in order to feed the trailing second portion 26 of the printed products 24 to the second branch 13 of the infeed or conveying means 2 as shown in FIG. 2. Now while the products 24 of the second product portion 26 travel towards the wind-up location 3, the printed products 24 of the first product portion 25 are removed from the intermediate package 27 formed at the intermediate winding core 16. Therefore, the supply roller or roll 18 is driven and a slight braking force is applied to the winding core 16. In this way the printed products 24 of the first product portion 25 are unwound from the winding core 16 and arrive at the conveyor belt rocker 22 via the conveyor belt 21 at which place they are joined with the printed products 24 of the second product portion 26. As shown in FIG. 2, the products 24 of the second product portion 26 come to lie upon the products 24 of the first product portion 25. Thus, a twin-layer imbricated product formation is supplied to the winding core 7 via the conveyor belt rocker 22. The stream of products is wound upon the winding core 7, the separation wind-up band 9 being interposed between each of the twin-layer wound-up layers wound upon the winding core 7 and which separation band separates the individual wound layers. The winding of the printed products 24 upon the winding core 7 has been described in greater detail in the commonly assigned copending U.S. patent application Ser. No. 432,557, filed Oct. 4, 1982, entitled "Apparatus for the Storage of Flat Products Arriving in an Imbricated Formation, Especially Printed Products", and the commonly assigned, copending U.S. patent application Ser. No. 06/280,998, filed July 6, 1981, now U.S. Pat. No. 4,438,618, granted Mar. 27, 1984, entitled "Apparatus for Stacking Printed Products, Such as Newspapers, Periodicals, and the Like, Arriving in an Imbricated Product Stream" which are incorporated herein by reference.

As will be evident from FIG. 2, the printed products 24 of the first product portion 25 are removed from the intermediate product package 27 with an open leading side 24*b;* these products 24 are fed to the winding core 7 in the direction of the arrow E. That is, the folding edge 24*a* now forms the trailing edge. Contrary thereto, the printing products 24 of the second product portion 26 arrive at the winding core 7 with the folding edge 24*a* in a leading position. There will result therefrom that the printed products 24 in each layer or ply of the twin-layer wound-up upon the winding core 7 are differently positioned.

If the primary product package 28 formed upon the winding core 7 has achieved the intended size, the switching means 11 are again switched or reversed in position. The printed products 24 which continue to arrive are then wound in the manner described upon the winding core 16 which meanwhile has been completely emptied. During formation of the intermediate product package upon the winding core 16 the frame 5 including the full-sized or complete product package 28 can be removed from the wind-up station 1 and can be replaced by another frame 5 containing an empty winding core 7. Thus, the continuously arriving stream of products does not have to be stopped during this exchange operation.

Withdrawal of the printed products 24 from the primary product package 28 may be achieved in the manner described in the accompanying and commonly assigned, copending U.S. patent application Ser. No. 06/445,564, filed Nov. 29, 1982, entitled "Method of, and Apparatus for, Removing Flat Products, Especially Printed Products From a Winding Core", the disclosure of which is incorporated herein by reference. Consequently, during unwinding the printed products 24 of one layer may be removed with the folding edge 24*a* in the leading position, that is to say, in the same configuration in which they have been originally supplied to the wind-up station 1.

It will be understood that the apparatus as described hereinbefore, as to various ones of its parts, may be designed differently from that described. Some of the possible variations and modifications are indicated briefly in the following disclosure.

Although the common arrangement of the winding core 7 and the spool member 8 for the separation wind-up band 9 in a mobile frame 5 is of specific advantage in handling the apparatus, the spool member 8 and the winding core 7 also may be arranged in the stationary frame 14. In this case, however, the shaft 6 of the winding core 7 will have to be conveniently journaled in such a way as to be removable. Instead of winding-up the printed products 24 of the first and second product portions 25 and 26 upon one other as shown, both the portions 25 and 26 of the stream of printed products also may be simultaneously wound-up upon the winding core 7 while in juxtaposition to each other.

It will also be understood that in the manner described other flat products such as, for example, sheets of paper, sacks or the like may be wound-up.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A method of storing continuously arriving substantially flat products, especially printed products, preferably arriving in an imbricated product formation, comprising the steps of:

conveying a continuous stream of products towards a wind-up station including a wind-up location equipped with a winding core;

forming from said stream of products a leading first product portion and a subsequent second product portion;

delivering said first product portion after a predetermined delay time to said wind-up location; and simultaneously winding-up said first product portion and said second product portion of said stream of products at said wind-up location.

2. The method as defined in claim 1, further including the steps of:

initially winding-up the first product portion into an intermediate package; and thereafter infeeding the first product portion of the intermediate package in conjunction with the second product portion to the winding core.

3. The method as defined in claim 2, further including the steps of:

winding-up the first and second product portions while superimposed upon one another.

4. The method as defined in claim 1, further including the steps of:

winding-up the first and second product portions while superimposed upon one another.

5. The method as defined in claim 1, further including the steps of:

infeeding the first and second product portions from below to said winding core.

6. The method as defined in claim 1, further including the steps of:

winding-in at least one separation layer between wound plies of the first and second product portions during winding-up of said first and second product portions.

7. The method as defined in claim 6, further including the steps of:

using as the separation layer a tensioned separation layer.

8. An apparatus for storing continuously arriving substantially flat products, especially printed products, preferably arriving in an imbricated product formation, comprising:

a wind-up location including a drivable winding core;

an infeed device for infeeding the products towards the wind-up location;

said infeed device including means for the delayed infeed of a first leading portion of the products to the wind-up location and for simultaneously infeeding said first portion of the products and a second subsequent portion of the products to the wind-up location; and means including said drivable winding core for simultaneously winding up said first and second product portions onto said drivable winding core.

9. The apparatus as defined in claim 8, wherein:

said means of said infeed device comprises:

a first branch for the delayed infeed of the first portion of the products to the wind-up location;

a second branch for the direct infeed of the second portion of the products to the wind-up location; and switching means for the selective charging of one of the branches with products.

10. The apparatus as defined in claim 9, wherein:

said first branch contains a bidirectionally drivable winding core for forming an intermediate package from the first portion of the products.

11. The apparatus as defined in claim 10, further including:

at least one storage means for a separation band; and said separation band having one end connected with said bidirectionally drivable winding core and being windable between wound plies of the intermediate package.

12. The apparatus as defined in claim 11, wherein:

said at least one storage means comprises a supply spool for the separation band.

13. The apparatus as defined in claim 11, wherein:

said separation band comprises a tensioned band.

14. The apparatus as defined in claim 10, wherein:

said first branch includes a support element arranged forwardly of and below the bidirectionally drivable winding core; and said support element serving for infeeding the products from below to the bidirectionally drivable winding core.

15. The apparatus as defined in claim 11, wherein:

said first branch includes a support element arranged forwardly of and below the bidirectionally drivable winding core; and said support element serving for infeeding the products from below to the bidirectionally drivable winding core.

16. The apparatus as defined in claim 8, further including:

at least one storage means for a separation band; and said separation band constituting part of said simultaneously winding-up means and being connected at one end with the winding core of said wind-up location and being windable between wound plies of a primary product package wound upon said winding core of said wind-up location.

17. The apparatus as defined in claim 16, wherein:

said storage means comprises a supply roll for said separation band.

18. The apparatus as defined in claim 9, further including:

at least one storage means for a separation band; and said separation band constituting part of said simultaneously winding-up means and being connected at one end with the winding core of said wind-up location and being windable between wound plies of a primary product package wound upon said winding core of said wind-up location.

19. The apparatus as defined in claim 9, wherein:

said second branch includes a support element arranged forwardly of and below the winding core of the wind-up location for infeeding the products from below to said winding core of said wind-up location; and said support element being common to said first and second branches.

20. The apparatus as defined in claim 8, wherein:

said winding core of said wind-up location serves to wind thereon a primary product package; and a mobile frame means in which there is mounted said winding core of said wind-up location.

21. The apparatus as defined in claim 20, further including:

storage means for a separation band to be wound between wound product plies of the primary package;

said separation band constituting part of said simultaneously winding-up means; and said storage means being mounted at said mobile frame means.

* * * * *